United States Patent [19]

Zwiener

[11] Patent Number: 4,467,841

[45] Date of Patent: Aug. 28, 1984

[54] CLAMPING JAW ARRANGEMENT OF A THREAD CLAMP FOR TEXTILE YARNS OR THE LIKE

[75] Inventor: Rudolf Zwiener, Arbon, Switzerland

[73] Assignee: Aktiengesellschaft Adolf Saurer, Arbon, Switzerland

[21] Appl. No.: 462,429

[22] Filed: Jan. 31, 1983

Related U.S. Application Data

[63] Continuation-in-part of Ser. No. 183,085, Sep. 2, 1980.

[51] Int. Cl.[3] ..... D03D 47/00

[52] U.S. Cl. ..... 139/429; 139/194; 242/149

[58] Field of Search ..... 139/429, 430, 450, 448, 139/194; 66/134, 140 S, 142, 145; 242/149

[56] References Cited

U.S. PATENT DOCUMENTS

| | | | |
|---|---|---|---|
| 2,624,370 | 3/1951 | Flamand | 139/429 |
| 3,348,582 | 10/1967 | Brookshire | 139/194 |
| 3,393,712 | 7/1968 | Franser | 139/194 |
| 3,851,676 | 12/1974 | Kokkinis | 139/448 |

FOREIGN PATENT DOCUMENTS

| | | |
|---|---|---|
| 216980 | 8/1961 | Austria . |
| 1836160 | 8/1961 | Fed. Rep. of Germany . |
| 2143641 | 12/1974 | Fed. Rep. of Germany . |
| 2552617 | 11/1968 | France . |

*Primary Examiner*—Henry Jaudon

*Attorney, Agent, or Firm*—Werner W. Kleeman

[57] ABSTRACT

A thread clamp for textile yarns or the like comprises two clamping jaw supports which can be moved relatively towards and away from one another. Each of the clamping jaw supports carries a respective clamping jaw. The clamping jaw of one of the clamping jaw supports is constructed as a clamping hood which is seated upon a substantially block-shaped intermediate layer formed of a rubber-elastic or elastomeric material. The intermediate layer has a portion thereof seated in a form-locking fashion in a recess provided at a base plate at said one clamping jaw support. These measures enable particularly realizing an optimum clamping action due to the oscillation-dampening properties of the intermediate layer supporting the clamping surface.

3 Claims, 3 Drawing Figures

CLAMPING JAW ARRANGEMENT OF A THREAD CLAMP FOR TEXTILE YARNS OR THE LIKE

CROSS REFERENCE TO RELATED APPLICATION

This application is a continuation-in-part application of my commonly assigned copending U.S. application Ser. No. 06/183,085, filed Sept. 2, 1980, and entitled "CLAMPING JAW ARRANGEMENT OF A THREAD CLAMP FOR TEXTILE YARNS OR THE LIKE".

BACKGROUND OF THE INVENTION

The present invention relates to a new and improved construction of a clamping jaw arrangement for a thread clamp for textile yarns or other thread-like or filamentary material, which is of the type comprising two clamping jaw supports which can be moved relatively towards and away from one another, and at each of these clamping jaw supports there is formed a respective clamping jaw.

One such type arrangement has been disclosed in U.S. Pat. No. 3,348,582. Here, the clamping jaws are each formed of a rubber block, secured at the related clamping jaw support, provided with a subsequently merging steel plate and a ceramic or porcelain plate which is mounted upon such steel plate. Due to this elastic supporting of the thread clamping surfaces there should be prevented the co-oscillations along with the jarring effects at the loom which reduces the thread retention force of the thread clamping surfaces.

What is disadvantageous with such clamping jaw arrangements is the relatively large mass of the steel plate and ceramic plate upon the elastic rubber block. Hence, the entire assembly, with increasing thread velocity or in resonance with the loom vibrations nonetheless again begins to oscillate, so that in the most unfavourable situation the retention or holding force for the thread can drop to null.

SUMMARY OF THE INVENTION

Therefore, with the foregoing in mind it is a primary object of the present invention to provide a new and improved construction of a clamping jaw arrangement of a thread clamp for textile yarns or the like, which is not associated with the aforementioned drawbacks and limitations of the prior art constructions.

Another and more specific object of the present invention aims at constructing a clamping jaw arrangement of the previously mentioned type such that all occurring oscillations, independent of increasing thread velocities, at least can be dampened to an uncritical mass or degree and the clamping surfaces are maintained in contact with one another to a sufficient degree even in the presence of wear.

Another and more specific object of the present invention is directed to providing a new and improved construction of a clamping jaw arrangement for a thread clamp for textile yarns or the like, which is relatively simple in construction and design, economical to manufacture, extremely reliable in operation, not readily subject to breakdown or malfunction, and requires a minimum of maintenance and servicing.

Now in order to implement these and still further objects of the invention, which will become more readily apparent as the description proceeds, the clamping jaw arrangement of the present development is manifested by the features that at least one of the clamping jaws is constituted, in known manner, by a wear-resistance support or contact element arranged upon a substantially block-shaped intermediate layer formed of a rubber elastic or elastomeric material. The block-shaped intermediate layer or element is fixedly connected with the related clamping jaw support. The wear-resistant support or contact element encloses the intermediate layer or element at least partially in a hood-shaped fashion.

Due to these measures it is now possible to design the inventive arrangement so as to be extremely lightweight. This arrangement, by virtue of the reduced mass of the hood-shaped support or contact element, exhibits an optimum dampening effect. Moreover, the clamping surface, even in the presence of extremely high thread velocities, can accommodate itself to the thread or other filamentary material, without oscillating or vibrating. Additionally, the hood-shaped support element, surrounding the rubber block, protects this rubber block against mechanical damage and other effects, thereby appreciably increasing the longevity of such rubber block.

Additionally, it is advantageous if the hood-shaped contact or support element is fixedly or rigidly connected with the end surface of the intermediate layer or element. This can be obtained if the hood-shaped support or contact element is inserted upon the intermediate layer or element at least with a tight or force fit.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Describing now the drawings, the conventional construction of thread clamp illustrated in FIG. 1 by way of example and described more fully hereinafter, has here only been shown intended, for instance, as a thread clamp for the transfer of a filling or weft thread tip to a shuttleless loom. Of course, the inventive measures and design also can be utilized at thread clamps of different construction and having other intended uses at the loom.

Figure 1:
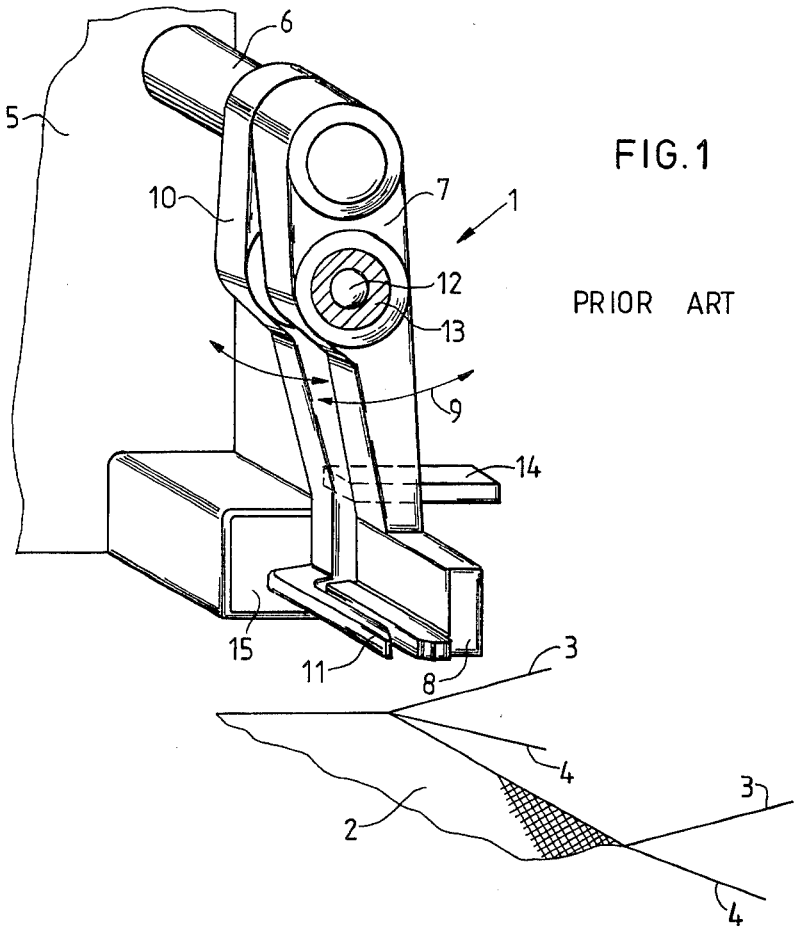
FIG. 1 PRIOR ART
FIG. 1 illustrates in perspective view a thread clamp for a shuttleless loom of a type known to the art, this thread clamp being intended to here transfer the tip of the filling or weft thread.

According to the showing of FIG. 1, the thread clamp 1 is located near to the edge of the woven fabric or cloth 2 in alignment with the weaving shed formed by the warp threads 3 of the upper shed and the warp threads 4 of the lower shed. The thread clamp 1 has assigned to it the task of clampingly retaining a filling or weft thread which has been inserted by a not here further shown, but conventional weft thread-insertion element.

To this end, the thread clamp 1 comprises a pivotal or oscillatory lever 7 which is connected rigidly for rotation with a rotatable shaft 6 rotatably mounted at the loom frame 5. This oscillatory lever 7 constitutes a first clamping jaw support or carrier. This clamping jaw support 7 contains at its free end an elongate clamping jaw 8 which extends in the direction of weft thread insertion.

The shaft 6 is driven in conventional manner in an alternating direction of rotation, in other words is oscillated back and forth, in conventional manner in cycle with the movement of the sley of the loom. Hence, the clamping jaw support 7 has imparted thereto an oscillatory movement indicated by the double-headed arrow 9.

Rotatably mounted upon the aforementioned shaft 6 is a second clamping jaw support 10, which carries at its free end a clamping jaw 11 which extends essentially parallel to the clamping jaw 8 provided at the clamping jaw support 7. Furthermore, in this arrangement the second clamping jaw support 10 possesses in radial spaced relationship from the driven shaft 6 a pin or journal 12. This pin or journal 12 extends parallel to the shaft 6 up to the region of the clamping jaw support 7 and piercingly extends through such into a cylindrical rubber sleeve or bushing 13 which is imbedded in a not particularly referenced bore of the clamping jaw support 7. With the illustrated embodiment, the mounting or bearing arrangements of the rubber sleeve 13 in the clamping jaw support 7 and the pin or journal 12 in the clamping jaw support 10 are arranged in offset relationship with respect to one another such that the clamping jaws 8 and 11 resiliently press against one another without the need for any additional external action.

During the pivotal or oscillatory motion of the clamping jaw supports 7 and 10 to the right of the showing of FIG. 1 the clamping jaw support 10 comes into contact with a stationary stop or impact member 14, whereas the other clamping jaw support 7 tends to move or pivot further, thereby separating the clamping jaws 8 and 11 from one another. As a result, the thread clamp 1 is opened for the purpose of either receiving or releasing a thread or the like. Upon release of the thread such can be taken-over by a simple suction nozzle 15.

Such an arrangement has been described in detail in U.S. application Ser. No. 118,641, filed Feb. 4, 1980, entitled "Mechanism on Shuttleless Looms for the Transfer of the End of the Weft Yarn".

Now in order to be able to fulfil the heretofore mentioned conditions, it is possible for the clamping jaws 8 and/or 11 to be designed according to the illustration of FIGS. 2 and 2A which will be discussed more fully hereinafter.

Figure 2:
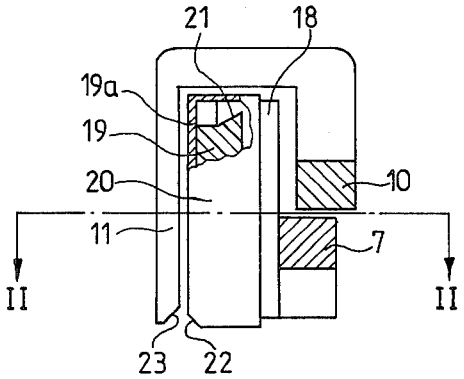
FIG. 2 is a plan view, partly in section, of an inventive clamping jaw arrangement for a thread clamp of the type shown in FIG. 1.
Figure 2A:
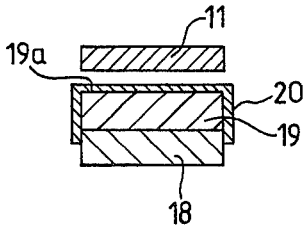
FIG. 2A is a sectional view, taken substantially along the line II—II of FIG. 2 and turned approximately 90° in the plane of the drawing.

By reverting to FIGS. 2 and 2A it will be seen that a substantially block-shaped intermediate layer 19 formed of an elastomeric or rubber elastic material and providing an oscillation dampening element is seated upon a base plate 18 provided at the clamping jaw support or carrier 7. This block-shaped intermediate layer or element 19 is surrounded in straddling fashion by a clamping hood or hood-shaped element 20, for instance formed of steel plate which is preferably treated so as to have improved surface properties and defines a wear-resistant support element.

With this arrangement the intermediate layer 19 is preferably seated partially in form-locking fashion in a here dovetail-shaped recess 21 provided at the clamping jaw support 7 or at the base plate 18, respectively. The clamping hood or element 20, as illustrated, can be fixedly connected with the end surface or face **19*a* of the intermediate layer or element 19, for instance by adhesive bonding or vulcanisation, and the entire unit or assembly can guidingly overlap past the extent of the base plate 18. Alternatively, the clamping hood 20 also can be inserted with a tight fit upon the part of the intermediate layer or element 19 which protrudes from the base plate 18. In each case there can be obtained a good connection and guiding of the wear-resistant clamping hood 20 upon the oscillation dampening intermediate element 19 which, in turn, is supported by the base plate 18**.

As further will be recognised by referring to FIG. 2, the clamping hood 20 is provided at the thread infeed or run-in side with a pronounced infeed or run-in edge 22 which is situated opposite a run-in or infeed edge 23 provided at the clamping jaw 11 of the clamping jaw support 10.

At this location it is mentioned that the previously described construction of the clamping jaw 8 with the intermediate layer or element 19 and clamping hood 20 at the clamping jaw support 7 could be equally or similarly provided at the other clamping jaw support 10 for the clamping jaw 11.

The undertaken measures first of all allow for an effective dampening of the vibrations transmitted by the loom due to the elastic supporting of at least one of the clamping surfaces, which additionally can accommodate itself in every direction to the thread or yarn and the counter surface, resulting in an optimum clamping capability of the thread clamping arrangement. Nonetheless, the relative movement between both of the clamping surfaces for the purpose of opening the thread clamp need not be very large, since the elastic action of the elastomeric intermediate layer, upon pressure release, and comparable to a spring, is consumed after the shortest movement or stroke.

While there are shown and described present preferred embodiments of the invention, it is to be distinctly understood that the invention is not limited thereto, but may be otherwise variously embodied and practiced within the scope of the following claims. Accordingly,

What I claim is:

1. A clamping jaw arrangement for a thread clamp for textile yarns or the like, comprising:

two clamping jaw supports;

means for mounting said two clamping jaw supports for relative movement towards and away from one another;

a clamping jaw formed at each of said clamping jaw supports:

at least one of the clamping jaws comprises a wear-resistant support element, a block-shaped intermediate layer and a base plate;

said block-shaped intermediate layer being formed of elastomeric material fixedly connected by said base plate with said one of the clamping jaw supports and providing an oscillation dampening element for said one clamping jaw support;

said wear-resistant support element being mounted in straddling fashion to surround said block-shaped intermediate layer and being fitted for guidance around said base plate; and said wear-resistant support element protectively enclosing completely in a hood-shaped manner said oscillation dampening intermediate layer and partially enclosing said base plate.

2. The clamping jaw arrangement as defined in claim 1, wherein:

said hood-shaped support element is fixedly connected with an end surface of said oscillation dampening intermediate layer.

3. The clamping jaw arrangement as defined in claim 1, wherein:

said hood-shaped support element is at least partially inserted with a tight fit onto said oscillation dampening intermediate layer.

* * * * *